US011280086B2

(12) United States Patent
Birsel et al.

(10) Patent No.: US 11,280,086 B2
(45) Date of Patent: Mar. 22, 2022

(54) SUBARCHITECTURAL OFFICE SYSTEM

(71) Applicant: HERMAN MILLER, INC., Zeeland, MI (US)

(72) Inventors: Ayse Birsel, New York, NY (US); Bibi Seck, New York, NY (US); Andrew Kurrasch, Saugatuck, MI (US)

(73) Assignee: MillerKnoll, Inc., Zeeland, MI (US)

( * ) Notice: Subject to any disclaimer, the term of this patent is extended or adjusted under 35 U.S.C. 154(b) by 0 days.

(21) Appl. No.: 16/922,454

(22) Filed: Jul. 7, 2020

(65) Prior Publication Data

US 2020/0332522 A1 Oct. 22, 2020

Related U.S. Application Data

(63) Continuation of application No. 15/919,861, filed on Mar. 13, 2018, now Pat. No. 10,718,111.

(60) Provisional application No. 62/470,549, filed on Mar. 13, 2017.

(51) Int. Cl.
*E04B 2/74* (2006.01)

(52) U.S. Cl.
CPC .... *E04B 2/7433* (2013.01); *E04B 2002/7483* (2013.01)

(58) Field of Classification Search
CPC .. E04B 2002/7483; E04B 2/7433; E04B 2/74; E04B 2/7407; E04B 2/7416
See application file for complete search history.

(56) References Cited

U.S. PATENT DOCUMENTS 2,345,650 A ‡ 4/1944 Attwood ..... B62D 33/044 403/21
3,357,727 A ‡ 12/1967 Finkenstein ..... F16B 17/004 403/17
3,478,993 A ‡ 11/1969 Wyeroski ..... A47B 57/26 248/24
3,614,044 A ‡ 10/1971 Bard ..... A47B 81/002 248/11

(Continued)

FOREIGN PATENT DOCUMENTS

EP 1302301 A1 4/2003
WO W09322518 ‡ 11/1993

(Continued)

OTHER PUBLICATIONS

International Search Report with Written Opinion for related Application No. PCT/US2018/022184 dated Jul. 13, 2018 (18 pages).‡

(Continued)

*Primary Examiner* — Andrew J Triggs
(74) *Attorney, Agent, or Firm* — Michael Best & Friedrich LLP

(57) ABSTRACT

A subarchitectural office system including a first subarchitectural wall, a second subarchitectural wall, and a single arch extending between the first and second subarchitectural walls. The single arch including a first vertical post, a second vertical post, and a first overhead beam. The subarchitectural office system also includes a double arch extending between the first and second subarchitectural walls. The double arch includes a third vertical post, a fourth vertical post, a fifth vertical post, a second overhead beam, and a third overhead beam.

20 Claims, 12 Drawing Sheets

(56) References Cited

U.S. PATENT DOCUMENTS 3,620,558 A ‡ 11/1971 MacMillan ..... F16B 7/0446 403/29
3,666,298 A ‡ 5/1972 Reilly ..... A47B 47/0008 403/17
3,977,800 A ‡ 8/1976 Cassel ..... F16B 7/0446 403/17
3,993,720 A ‡ 11/1976 Burdett ..... E04B 1/162 264/33
4,130,977 A ‡ 12/1978 Taylor, Jr. ..... E04B 1/4107 52/710
4,139,316 A ‡ 2/1979 Svensson ..... F16B 12/50 403/17
4,204,375 A ‡ 5/1980 Good ..... E04B 2/7425 52/239
D256,663 S 9/1980 Gilb
4,249,830 A ‡ 2/1981 Day ..... F16B 7/0446 403/24
4,929,114 A ‡ 5/1990 Young ..... E04B 1/5831 403/17
4,948,313 A ‡ 8/1990 Zankovich ..... E04B 1/4107 411/10
5,005,848 A ‡ 4/1991 Cornell ..... B62B 5/0083 108/56
5,394,658 A ‡ 3/1995 Schreiner ..... A47B 21/06 312/19
5,406,760 A ‡ 4/1995 Edwards ..... E04B 2/7416 160/35
5,893,675 A ‡ 4/1999 Lange ..... F16B 7/0413 403/29
5,896,721 A ‡ 4/1999 Sugiyama ..... E04B 1/2604 403/23
5,899,025 A ‡ 5/1999 Casey ..... E04B 2/7453 108/50
5,950,371 A ‡ 9/1999 Rives ..... A47B 57/402 52/36
5,974,742 A ‡ 11/1999 Schreiner ..... A47B 21/06 52/239
6,073,399 A ‡ 6/2000 Shipman ..... A47B 96/00 40/607
6,112,472 A ‡ 9/2000 Van Dyk ..... A47B 83/001 52/220
6,189,268 B1 ‡ 2/2001 Carr ..... A47B 21/06 52/220
6,213,679 B1 ‡ 4/2001 Frobosilo ..... E04B 2/96 403/40
6,216,398 B1 ‡ 4/2001 Shipman ..... E04B 2/7453 108/50.01
6,240,682 B1 ‡ 6/2001 James ..... E04B 7/024 52/90
6,250,020 B1 ‡ 6/2001 Shipman ..... E04B 2/7433 52/238
6,279,643 B1 ‡ 8/2001 Shipman ..... E04B 2/7433 160/35
6,354,043 B1 ‡ 3/2002 Simon ..... E04B 2/7433 135/97
6,374,548 B1 ‡ 4/2002 Ruedinger ..... A47B 21/06 52/36
D462,548 S 9/2002 Ludwig et al.
6,470,644 B2 ‡ 10/2002 James ..... E04B 7/024 52/745
6,481,169 B1 ‡ 11/2002 Ludwig ..... E04B 2/7453 160/35
6,490,829 B1 ‡ 12/2002 Schreiner ..... A47B 21/06 160/19
6,497,075 B1 ‡ 12/2002 Schreiner ..... A47B 21/06 52/127
6,510,663 B2 1/2003 Jourden et al.
6,574,928 B2 6/2003 Mueller et al.
6,612,087 B2 9/2003 diGirolamo et al.
6,748,710 B2 6/2004 Gresham et al.
6,751,914 B2 6/2004 Zeh et al.
6,760,999 B2 7/2004 Branc
6,773,200 B2 ‡ 8/2004 Cole ..... B60D 1/60 403/21
6,786,017 B2 * 9/2004 Thompson ..... E04B 2/7433 248/519
6,807,776 B2 10/2004 Girdwood et al.
6,922,949 B2 ‡ 8/2005 Cornell ..... E04B 2/827 160/351
6,931,795 B1 8/2005 Baloga et al.
7,165,360 B2 * 1/2007 Thompson ..... E04B 2/7433 52/126.4
7,249,624 B2 ‡ 7/2007 Zeh ..... A47B 83/001 160/350
7,731,160 B2 ‡ 6/2010 Terrels ..... E04F 11/1836 256/65
7,827,920 B2 11/2010 Beck et al.
8,074,415 B2 * 12/2011 Terada ..... E04B 2/78 52/239
8,997,413 B2 4/2015 Anderson
9,010,062 B2 4/2015 Hill
10,538,913 B2 1/2020 Matthai et al.
10,718,111 B2 7/2020 Birsel et al.
2002/0124478 A1 ‡ 9/2002 Rush ..... E04B 2/7433 52/36.1
2003/0182871 A1 10/2003 Gresham et al.
2003/0200704 A1 10/2003 Cornell et al.
2005/0055888 A1 ‡ 3/2005 Gresham ..... A47B 83/001 52/36.1
2007/0033895 A1 ‡ 2/2007 Talpe ..... E05B 1/0015 52/698
2007/0193124 A1 * 8/2007 Thompson ..... E04H 12/2276 52/36.1
2007/0245677 A1 ‡ 10/2007 Nguyen ..... E04B 1/2403 52/698
2010/0101167 A1 ‡ 4/2010 Morey ..... E04B 9/183 52/506
2010/0126103 A1 ‡ 5/2010 diGirolamo ..... E04B 2/58 52/655
2015/0308098 A1 10/2015 Teasadori
2015/0345136 A1 * 12/2015 Murray ..... A47B 83/001 52/243.1
2016/0017614 A1 ‡ 1/2016 Kometas ..... E04F 19/0459 52/287
2016/0128469 A1 5/2016 Matthai et al.
2016/0138634 A1 ‡ 5/2016 Zhang ..... F16L 3/24 52/698
2016/0153185 A1 6/2016 Ter-Borch
2016/0159269 A1 6/2016 Squyres
2018/0258635 A1 ‡ 9/2018 Birsel ..... E04B 2/7433

FOREIGN PATENT DOCUMENTS

WO WO9322518 A1 11/1993
WO W097017504 ‡ 5/1997
WO WO97017504 A1 5/1997
WO W02014114299 ‡ 7/2014
WO WO2014114299 A1 7/2014

OTHER PUBLICATIONS

FastCompany, "Today's ,Workplace Is A Stage, Not An Office", https://www.fastcompany.com/3060752/todays-workplace-is-a-stage-not-an-office, website accessed Oct. 24, 2019.‡
Knoll and Rockwell, Unscripted, Website: (https://www.knoll.com/story/design-plan/rockwell-unscripted), website accessed Oct. 11, 2019.‡
Office Action issued by the US Patent Office for related U.S. Appl. No. 15/987,790 dated Nov. 26, 2018 (10 Pages).‡

* cited by examiner
‡ imported from a related application

SUBARCHITECTURAL OFFICE SYSTEM

CROSS-REFERENCE TO RELATED APPLICATIONS

This application is a continuation of U.S. patent application Ser. No. 15/919,861, filed Mar. 13, 2018 which claims priority to U.S. Provisional Patent Application No. 62/470,549, filed Mar. 13, 2017, the entire contents of all of which are incorporated by reference herein.

FIELD OF THE INVENTION

The present invention relates to a subarchitectural office system. More specifically, the present invention relates to a subarchitectural office system that has a subarchitectural office system including a subarchitectural wall and an arch.

BACKGROUND

Office spaces are generally moving to an "open concept" where the floor plans have minimal walls dividing the office. Typically, the floor plan of "open concept" offices make use of large, open spaces and minimizes the use of small, enclosed rooms such as offices. However, even with an "open concept" office, there still may be a need to break up the floor space to provide separate functional areas. Subarchitectural office systems provide the structure to maintain an "open concept" office space while still being able to split the floor into different functional areas.

SUMMARY

In one embodiment, the invention provides a subarchitectural office system including a subarchitectural wall having a top edge, a bottom edge, a first side edge, and a second side edge opposite the first side edge. The subarchitectural office system also includes a first arch adjacent the first side edge of the subarchitectural wall. The first arch includes a first vertical post adjacent the first side edge of the subarchitectural wall and a first overhead beam with a first end and a second end opposite the first end. The first end of the first overhead beam is coupled to the first vertical post, and the first overhead beam extends outwardly from the first vertical post. The first arch also includes a second vertical post positioned away from the subarchitectural wall and coupled to the second end of the first overhead beam. The subarchitectural office system further includes a second arch adjacent the second edge of the subarchitectural wall. The second arch includes a third vertical post adjacent the second side edge of the subarchitectural wall and a second overhead beam with a first end and a second end opposite the first end. The first end of the second overhead beam is coupled to the third vertical post, and the second overhead beam extends outwardly from the third vertical post. The second arch also includes a fourth vertical post positioned away from the subarchitectural wall and coupled to the second end of the second overhead beam.

In another embodiment, the invention provides a subarchitectural office system for use within a building having building walls. The subarchitectural office system includes a subarchitectural wall having a top edge, a bottom edge, a first side edge configured to be connected to a building wall, and a second side edge opposite the first side edge. The subarchitectural wall is configured to extend outwardly from the building wall. The subarchitectural office system further includes an arch adjacent the second side edge of the subarchitectural wall. The arch includes a first vertical post adjacent the second side edge of the subarchitectural wall and an overhead beam with a first end and a second end opposite the first end. The first end of the overhead beam is coupled to the first vertical post. The overhead beam extends outwardly from the first vertical post. The arch further includes a second vertical post positioned away from the subarchitectural wall and coupled to the second end of the overhead beam.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. It should be understood that the description of specific embodiments is not intended to limit the disclosure from covering all modifications, equivalents, and alternatives falling within the spirit and scope of the disclosure. Also, it is to be understood that the phraseology and terminology used herein is for the purpose of description and should not be regarded as limiting.

The term "laterally" or variations thereof refer to a sideways direction. The terms "top," "upper," "bottom," and "lower" are intended to indicate directions when viewing the subarchitectural office system when positioned for use. The term "coupled" means connected to or engage with, whether either directly or indirectly, for example with an intervening member, and does not require the engagement to be fixed or permanent, although engagement can be fixed or permanent. It should be understood that the use of numerical terms "first," "second," "third," etc. as used herein does not refer to any particular sequence or order of components; for example, "first" and "second" portions may refer to any sequence of such components, and is not limited to the first and second components of a particular configuration.

Figure 1:
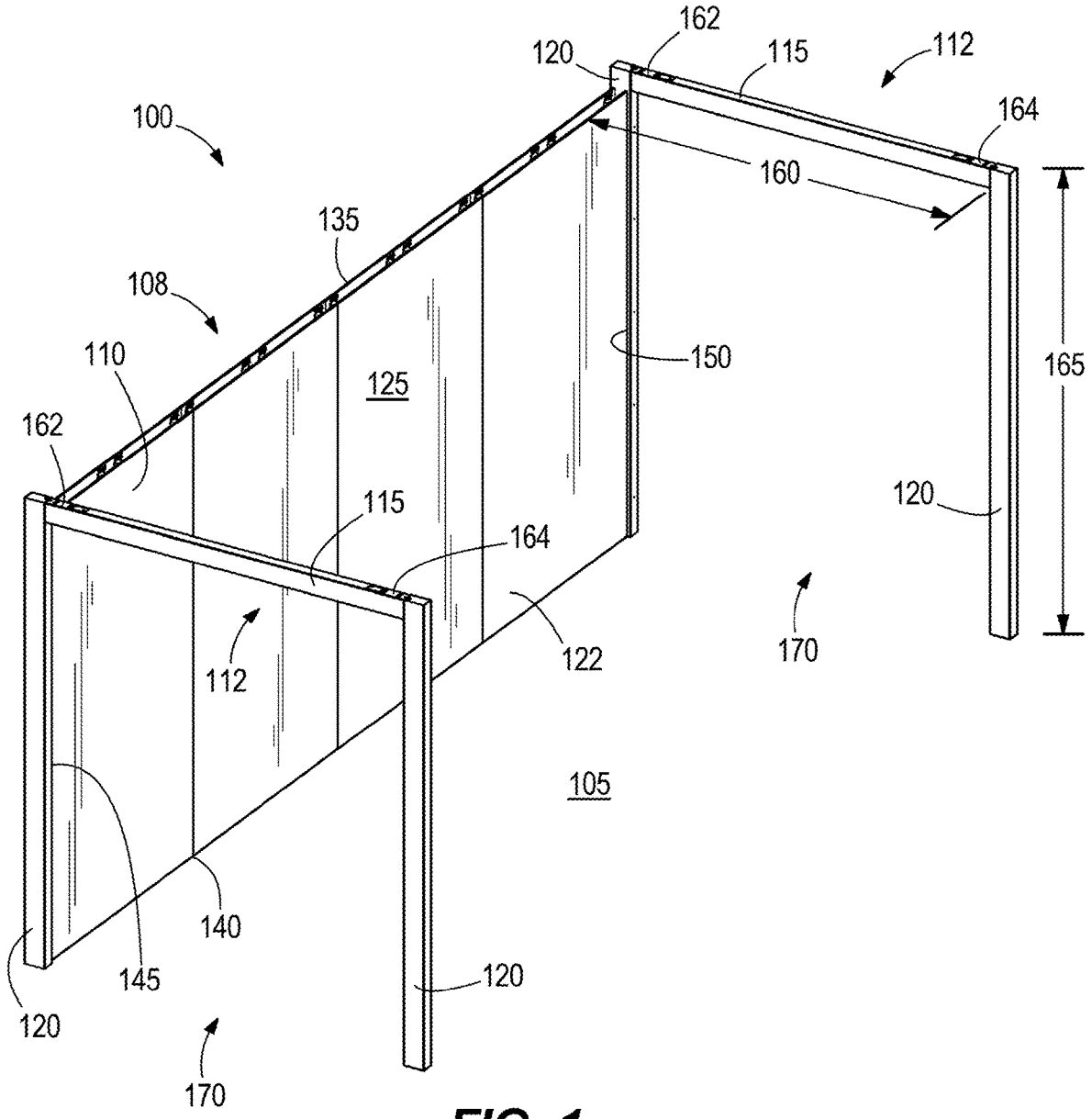
FIG. 1 is a perspective view of a subarchitectural office system.

Referring to FIG. 1, a subarchitectural office system 100 is configured to be constructed on a floor 105 of an open office. The subarchitectural office system 100 has many variations and can be constructed in various ways by the addition of lightweight core modules 108. As seen in FIG. 1, the core module 108 includes a subarchitectural wall 110 and at least one arch 112. "Subarchitectural" means the office system 100 does not contribute to the structural integrity of the building in which it is positioned. Rooms, floors, or office spaces in a building are typically defined by walls, floors, and ceilings. The office system 100 of the present invention, and specifically the subarchitectural wall 110, is separate from the walls, the floor, and the ceiling of the building As such, the office system 100 can be moved within or removed from the building without dismantling part of the building itself. Although, in some embodiments, the subarchitectural office system 100 may be anchored to the floor of the room with fasteners.

Figure 2:
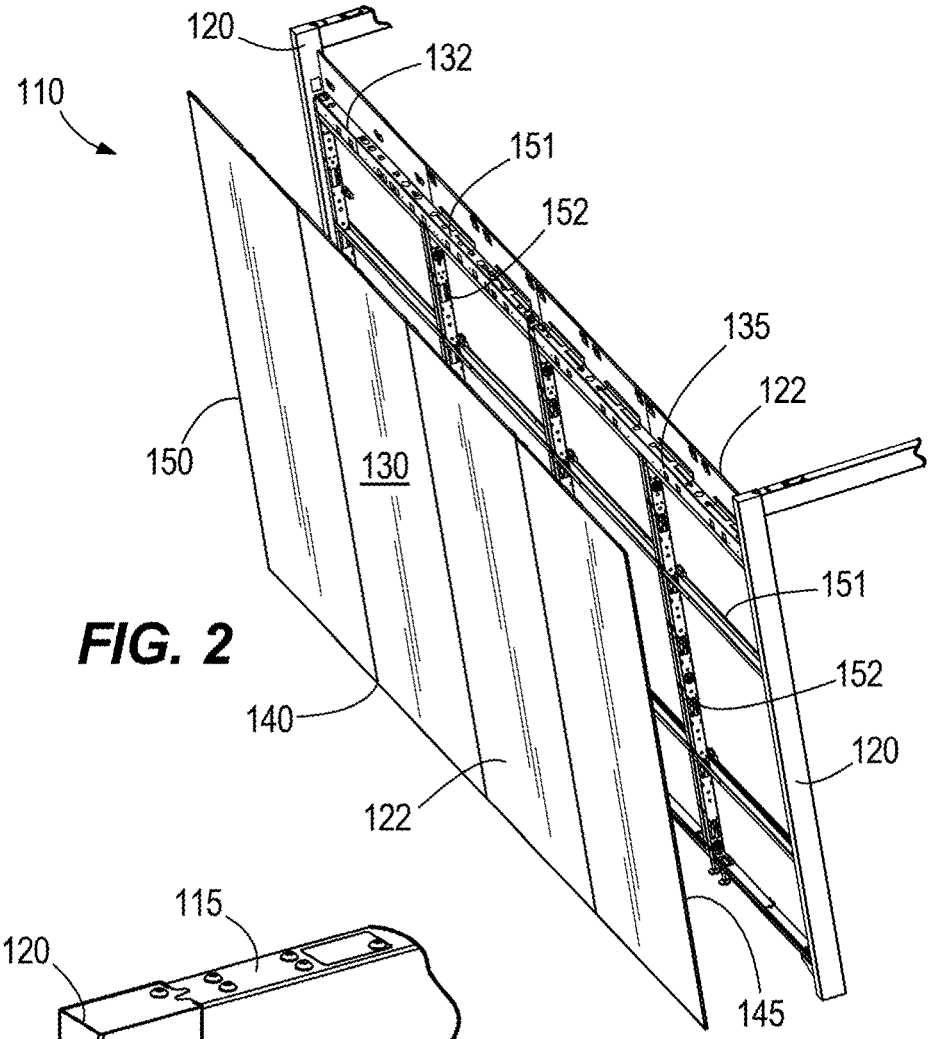
FIG. 2 is an exploded view of a subarchitectural wall of the subarchitectural office system of FIG. 1.

With reference to FIGS. 1 and 2, the subarchitectural wall 110 may also be referred to as a performance wall. The subarchitectural wall 110 includes a wall cladding 122 on a first side 125, a wall cladding 122 on a second side 130 (FIG. 2) opposite the first side 125, a top edge 135, a bottom edge 140, and two side edges (e.g., a first side edge 145 and a second side edge 150) opposite each other and spaced laterally from one another. In some embodiments, the wall cladding 122 may be vibrationally dampened to reduce the amount of sound that is transferred into or out of the subarchitectural office system 100.

The illustrated subarchitectural wall 110 is generally rectangular, and the first and second sides 125, 130 are generally planar. In other embodiments, the subarchitectural wall 110 may have other shapes. For example, the top edge 135 and/or the side edges 145, 150 may be angled or rounded so the subarchitectural wall 110 is pentagonal, hexagonal, or semi-circular or has other irregular shapes. Additionally or alternatively, the first and/or second side 125, 130 may be non-planar. The subarchitectural wall 110 may be formed of a suitable building material, such as a wood, metal, or plastic. In some embodiments, the subarchitectural wall 110 may be a multi-layered panel formed of the same or different materials. The sides 125, 130 of the subarchitectural wall 110 may also be coated with any desired paint, coating, fabric, or other surface treatment. In some embodiments, the subarchitectural wall 110 may include a rail 131 (FIG. 14) that accessories are able to be supported on. For example, the subarchitectural wall 110 may be a creative wall in which, whiteboards, tackboards, or other accessories or skins are attached. Further, TV's, lights, and electrical outlets, may be supported by the subarchitectural wall 110. The subarchitectural wall 110 may also be a frame and tile-type system in which accessories (or "tiles") are selectively connected.

In the illustrated embodiment, the arch 112 includes an overhead beam 115 and two vertical posts 120. The arch 112 may also be referred to as a spanner zone. The overhead beam 115 extends outwardly from a vertical post 120 adjacent one of the first or second side edges 145, 150 of the subarchitectural wall 110. The overhead beam 115 extends outwardly from the vertical post 120 a distance 160. The distance 160 may be, for example, between two and thirty feet. The illustrated overhead beam 115 has a first end 162 coupled to a vertical post 120 adjacent the top edge 135 of the subarchitectural wall 110, and a second end 164 spaced apart from the subarchitectural wall 110 and coupled to another vertical post 120. In some embodiments, the overhead beam 115 may be a metal tube having a rectangular cross-section. The overhead beams 115 may be coupled to the vertical posts 120 with bolts, screws, clips, or any suitable proprietary connection.

The vertical posts 120 are coupled to the first and second ends 162, 164 of the overhead beam 115 and extend a distance 165 between the floor 105 and the overhead beam 115. The distance 165 may be, for example, between seven and ten feet. Similar to the overhead beam 115, the vertical post 120 may also be a metal tube having a rectangular cross-section. The vertical post 120 may be coupled to the overhead beams 115 or subarchitectural walls 110 with bolts, screws, clips, or any suitable proprietary connection.

Additional arches 112 may also be coupled to the first and second side edges 145, 150 of the subarchitectural wall 110. In such embodiments, the vertical posts 120 may cap the ends of the subarchitectural wall 110. The subarchitectural wall 110 is then compressed or held between the additional vertical posts 120. In other words, a first vertical post 120 is coupled to the subarchitectural wall 110 adjacent the first side edge 145, and a second vertical post is coupled to the subarchitectural wall 110 adjacent the second side edge. If an arch 112 is positioned on both side edges of the subarchitectural wall 110, the subarchitectural wall 110 is compressed between two arches 112. Additionally, when the vertical posts are coupled to the subarchitectural wall 110, the vertical posts 120 extend above the top edge 135 of the wall 110. As such, the overhead beams 115 are coupled to the vertical posts 120 at a position above the top edge 135 of the subarchitectural wall 110.

Now referring to FIG. 2, the subarchitectural wall 110 also includes a wall structure 132. The wall structure 132 creates a space that separates the wall claddings 122. The wall structure 132 also provides support to the subarchitectural wall 110 allowing accessories to be supported by the subarchitectural wall 110. The space between the wall claddings 122 of the subarchitectural wall 110 allow electrical cords and wires to pass through to provide power to appliances on or near the subarchitectural wall 110. In addition, the space between the wall claddings 122 allows a user to secure the vertical post 120 to the subarchitectural wall 110 from the top edge 135.

Figure 3:
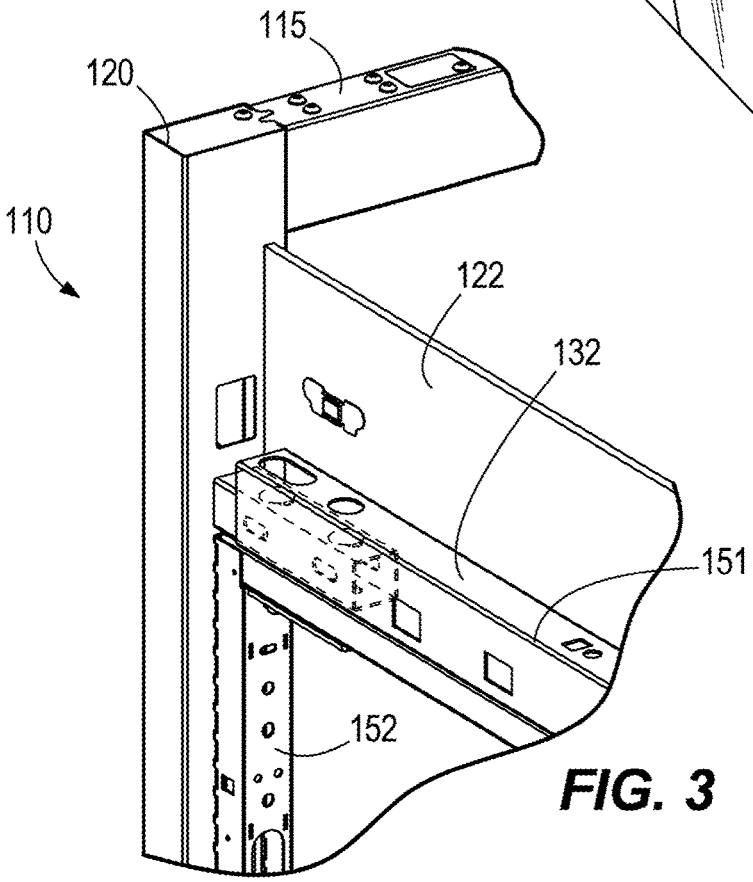
FIG. 3 is a close-up view of a portion of the subarchitectural wall of FIG. 2.

As shown in FIGS. 2 and 3, the wall structure 132 is defined by a plurality of vertical struts 151 and a plurality of horizontal struts 152. In the illustrated embodiment, the struts 151, 152 are connected together and arranged in a square patter (i.e., forming squares or grid). In other embodiments, the struts 151, 152 may be arranged in other patterns, or another suitable wall structure 132 may be positioned between the claddings 122. The wall structure 132 is coupled to the vertical posts 120 with fasteners (e.g., bolt, screw, clips, nail, catch and latch, etc.). Fasteners are also used to secure the wall claddings 122 to the wall structure 132. As the fasteners are tightened, the fasteners draw the vertical posts 120 toward each other, securing and compressing the subarchitectural wall 110 (and, more particularly, the wall claddings 122) between the vertical posts 120. Such an arrangement creates an aesthetically clean finish between the wall claddings 122 and the vertical posts 120, with little or no visible gap between the wall claddings 122 and the vertical posts 120.

Figure 10:
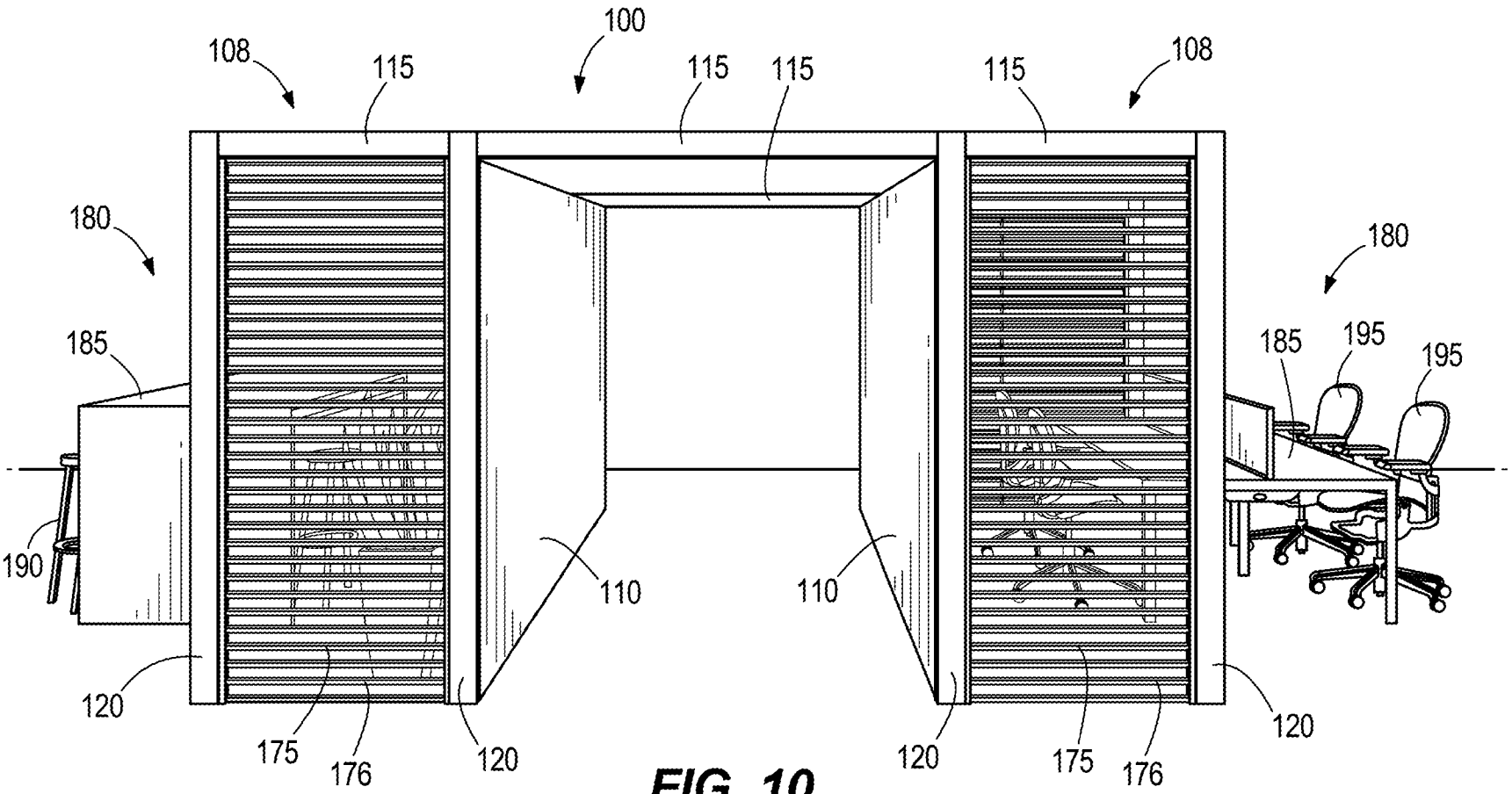
FIG. 10 is a front elevational view of another embodiment of a subarchitectural office system.
Figure 13:
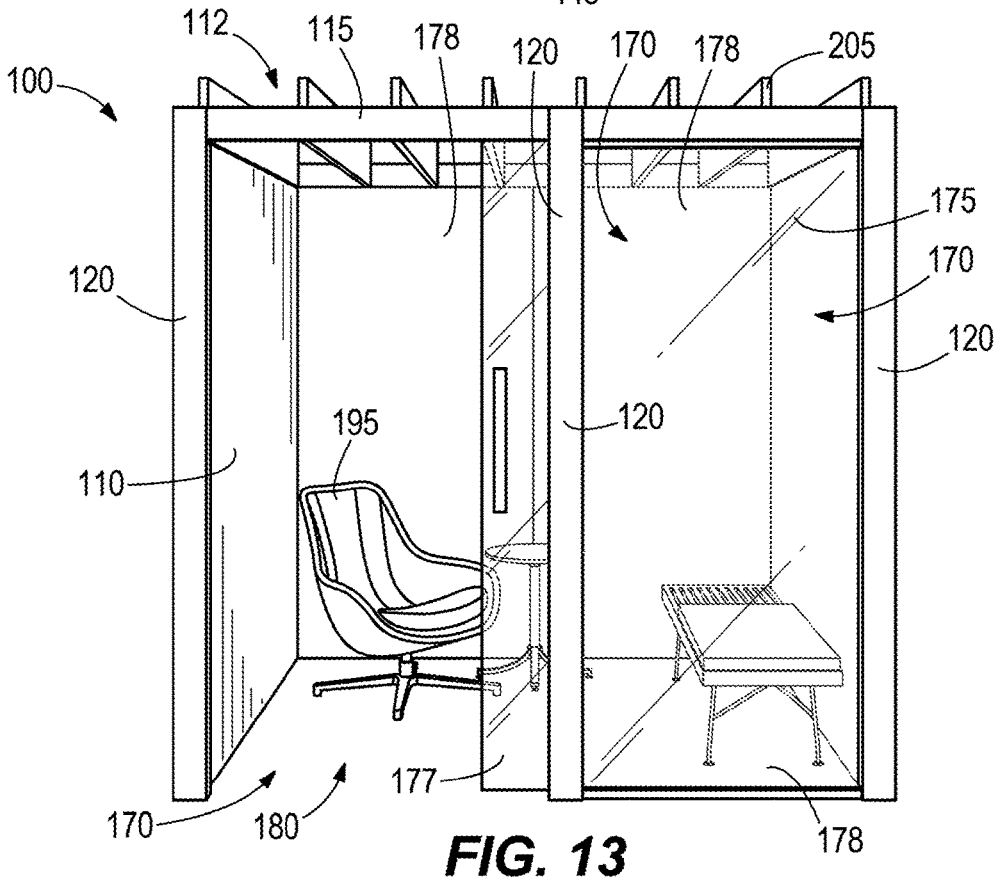
FIG. 13 is a front elevational view of yet another embodiment of a subarchitectural office system.
Figure 14:
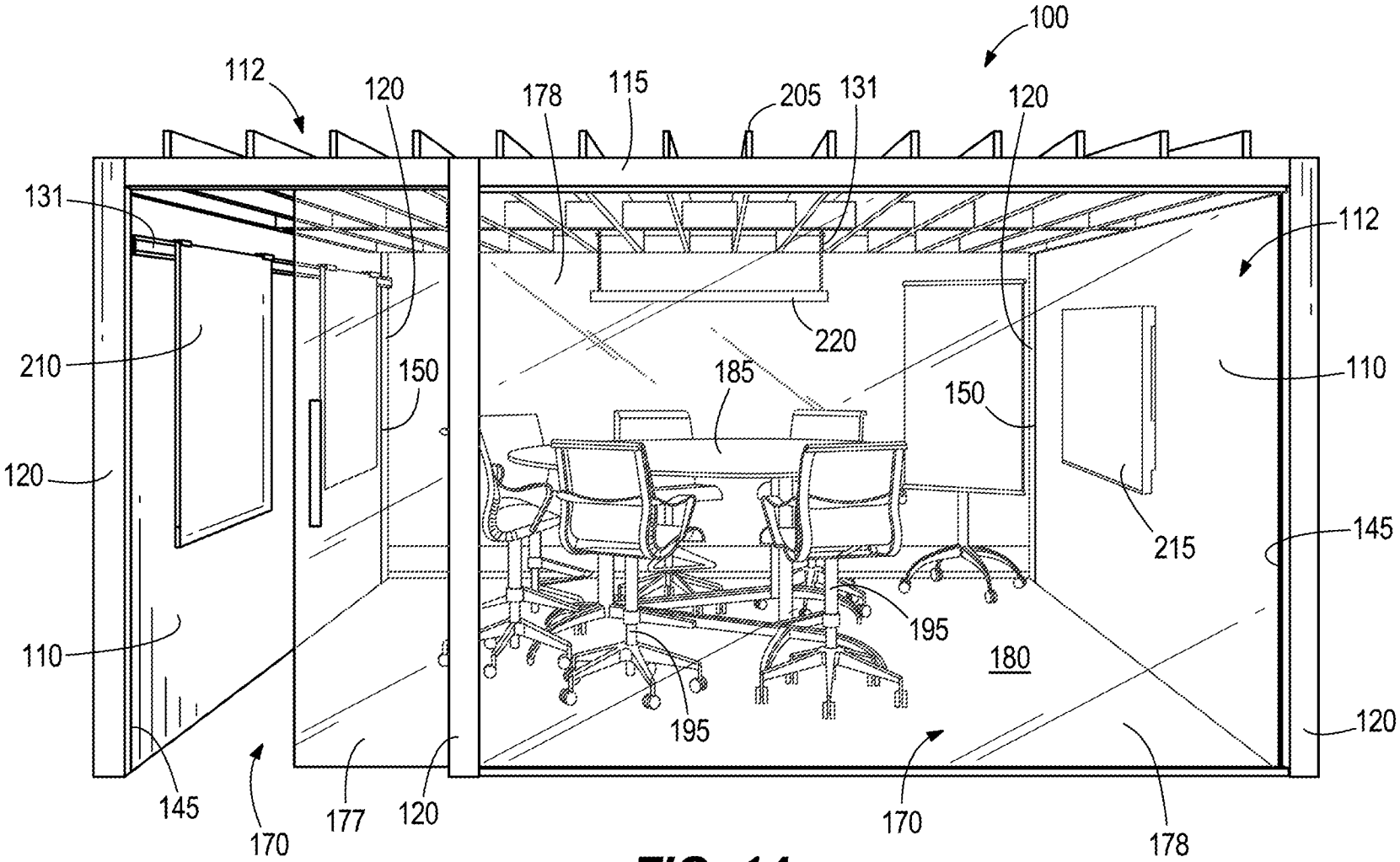
FIG. 14 is a front elevational view of yet another embodiment of a subarchitectural office system.

Referring back to FIG. 1, each arch 112 defines an opening 170 between the two vertical posts 120 and the overhead beam 115. The opening 170 may be used as a passageway for ingress to and egress from the inside of the subarchitectural office system 100. As shown in FIGS. 10 and 12-14, an infill 175 may be positioned within the opening 170 of each arch 112. The infills 175 may cover parts of each opening 170 or may cover the entire openings 170. In some embodiments, the infill 175 may include slats 176 (FIG. 10). The slats may be, for example, elongated wooden pieces that are spaced apart and arranged horizontally or vertically to cover the opening 170. In other embodiments, the infill 175 may include a door 177 (FIGS. 13 and 14). The door may be, for example, a sliding door or a hinged door, and may be made of glass, wood, fiberglass, composites, or other translucent, transparent, or semi-transparent materials. In further embodiments, the infill 175 may include a panel 178 (FIGS. 13 and 14). The panel 178 may be a solid panel, such as a glass panel, a fiberglass panel, a laminate panel, a whiteboard or other writable surface, or a wooden panel. In still further embodiments, other suitable infills may be positioned within the openings 175, such as curtains, banners, fabrics, and the like. In other embodiments, the infills may be perforated aluminum. Additionally, the infills 175 may be customized for a specific individual or company.

Referring back to FIG. 1, when assembled, the subarchitectural office system 100 including two arches 112 is self-supporting. In other words, the subarchitectural office system 100 is free-standing when positioned on the floor 105 within a room. The office system 100 does not need to be anchored to the floor 105 or an adjacent wall or ceiling to stay upright. The illustrated subarchitectural office system 100 is also sturdy enough to support secondary structures, such as individual workspaces, as further described below. In some embodiments, also described below, the subarchitectural office system 100 may be supported by a wall of a building for convenience or spacing requirements in the building.

In the illustrated embodiment, the subarchitectural wall 110 is a continuous subarchitectural wall 110. In further embodiments, two core modules 108 may be combined to form a longer subarchitectural wall 110 and a bigger subarchitectural office system 100.

In the illustrated embodiment, the second ends 164 of the overhead beams 115 are only connected to the corresponding vertical posts 120. That is, the second ends 164 of the overhead beams 115 are spaced apart from each other and free of any other connectors extending between the second ends 164, such as a crossbeam connecting the second ends 164 of the overhead beams 115. Such an arrangement simplifies the construction of the office system 100, and provides the subarchitectural office system 100 with a more open appearance.

In some embodiments, the subarchitectural office system 100 may further include a ceiling or roofing structure that either partially or entirely encloses the subarchitectural office system. For example, the subarchitectural office system 100 may include trellises 205 (FIGS. 13 and 14). The ceiling may be supported by the four vertical posts 120 and the two overhead beams 115 of the subarchitectural office system 100. When present, the ceiling gives the feeling of a more private space. In addition, the ceiling can help reduce harsh lighting and noise, yet still allow airflow into and out of the subarchitectural office system 100. The ceiling also provides a location to hang other accessories associated with the subarchitectural office system 100, such as lights, curtains or dividers, microphones, speakers, and the like.

Figure 4A:
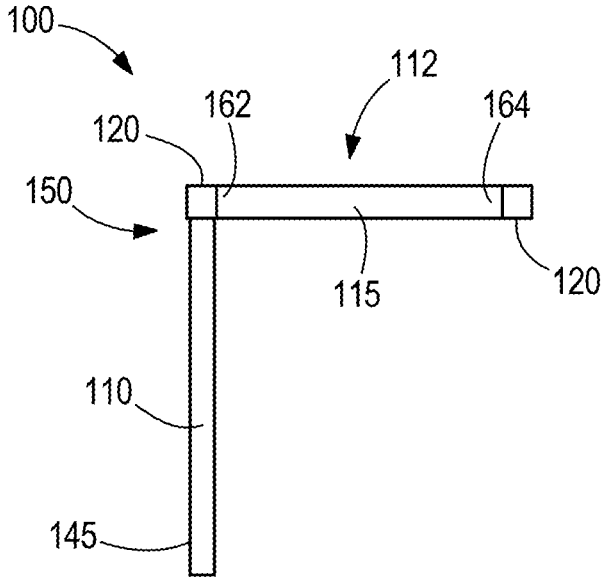
FIG. 4A is a top schematic view of another subarchitectural office system including a subarchitectural wall and an arch.

FIG. 4A illustrates an alternative subarchitectural office system 100. The illustrated subarchitectural office system 110 includes a subarchitectural wall 110 and a single arch 112 with an overhead beam 115, and two vertical posts 120. One vertical post 120 is positioned adjacent a side edge 150 of the subarchitectural wall 110, and the first end 162 of the overhead beam 115 is coupled to the top edge of the subarchitectural wall 110 at the one vertical post 120. The other vertical post 120 is positioned on the second end 164 of the overhead beam 115. The subarchitectural wall 110 is positioned relative to the overhead beam 115 adjacent the one vertical post 120 to form an "L-block." Stated another way, the overhead beam 115 and the subarchitectural wall 110 are orthogonal.

Figure 4B:
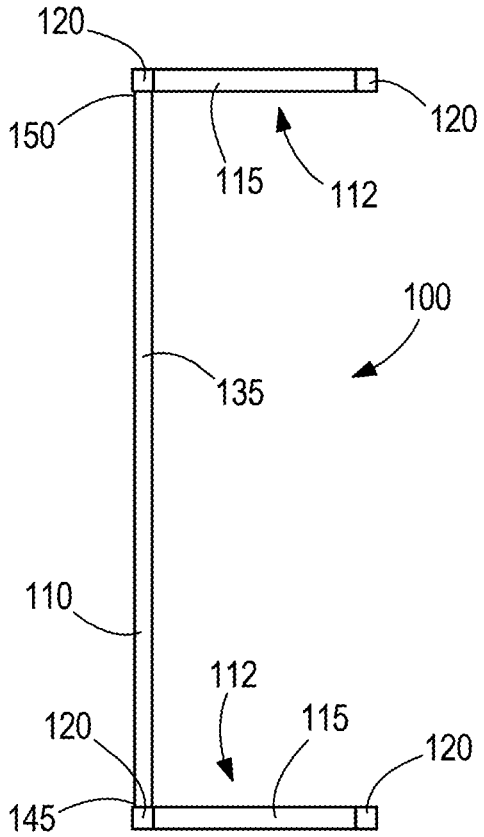
FIG. 4B is a top schematic view of another subarchitectural office system including a subarchitectural wall and two arches.

FIG. 4B illustrates a subarchitectural office system 100 similar to the subarchitectural office system 100 shown in FIG. 1. The illustrated subarchitectural office system 100 includes a subarchitectural wall 110 and two arches 112 so in total there are two overhead beams 115 and four vertical posts 120. A vertical post 120 is positioned at the first side edge 145 and another vertical post 120 is positioned at the second side edge 150 of the subarchitectural wall 110 to provide additional support to the subarchitectural wall 110. The overhead beams 115 are coupled to the two vertical posts 120 adjacent the side edges 145, 150 of the subarchitectural wall 110. The other two vertical posts 120 are coupled to the second ends 164 of the overhead beams 115 and spaced apart from the subarchitectural wall 110.

Figure 5:
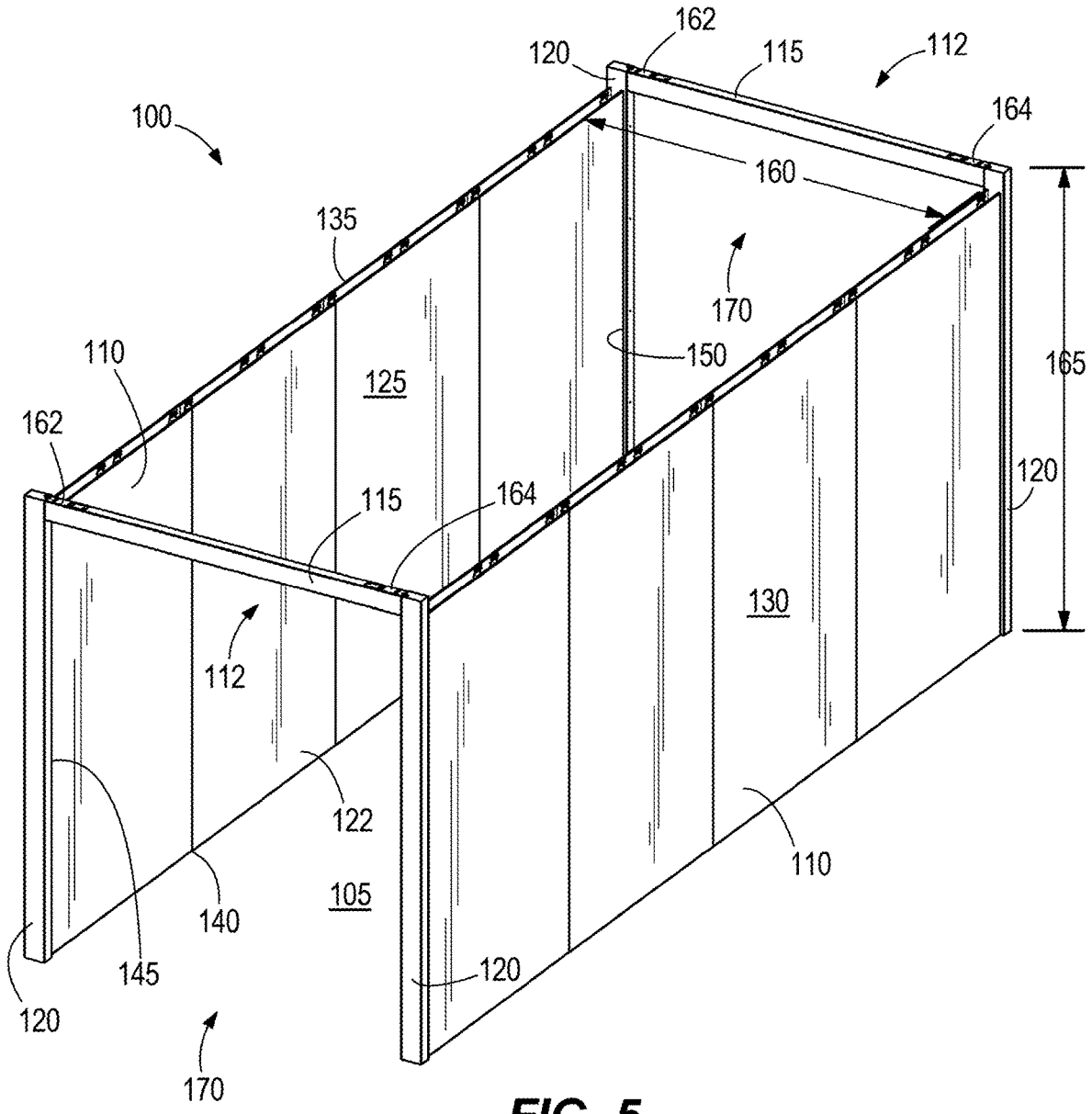
FIG. 5 is a perspective view of another subarchitectural office system including two subarchitectural walls and two arches.
Figure 6:
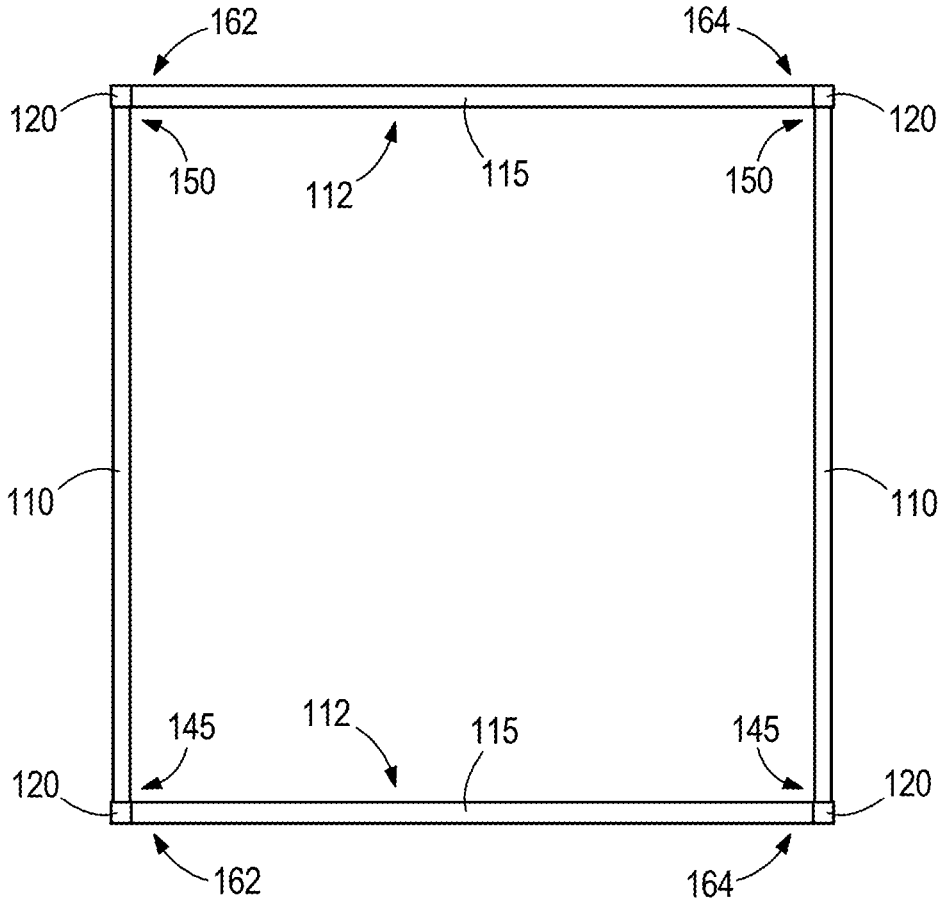
FIG. 6 is a top schematic view of the subarchitectural office system of FIG. 5.

FIGS. 5 and 6 illustrate yet another subarchitectural office system 100. The illustrated subarchitectural office system 100 includes two subarchitectural walls 110 and two arches 112 spanning between the two subarchitectural walls 110 so that in total there are two overhead beams 115 and four vertical posts 120. The subarchitectural walls 110 are spaced apart from and facing each other. Two vertical posts 120 are positioned at the side edges 145, 150 of one of the subarchitectural walls 110, and two vertical posts 120 are positioned at side edges 145, 150 of the other subarchitectural wall 110. Each overhead beam 115 includes a first end 162 coupled to the vertical post 120 adjacent one of the side edges 145, 150 of the first subarchitectural wall 110, and a second end 164 coupled to the vertical post 120 adjacent one of the side edges 145, 150 of the second subarchitectural wall 110. As such, the overhead beams 115 span between the subarchitectural walls 110.

Figure 7:
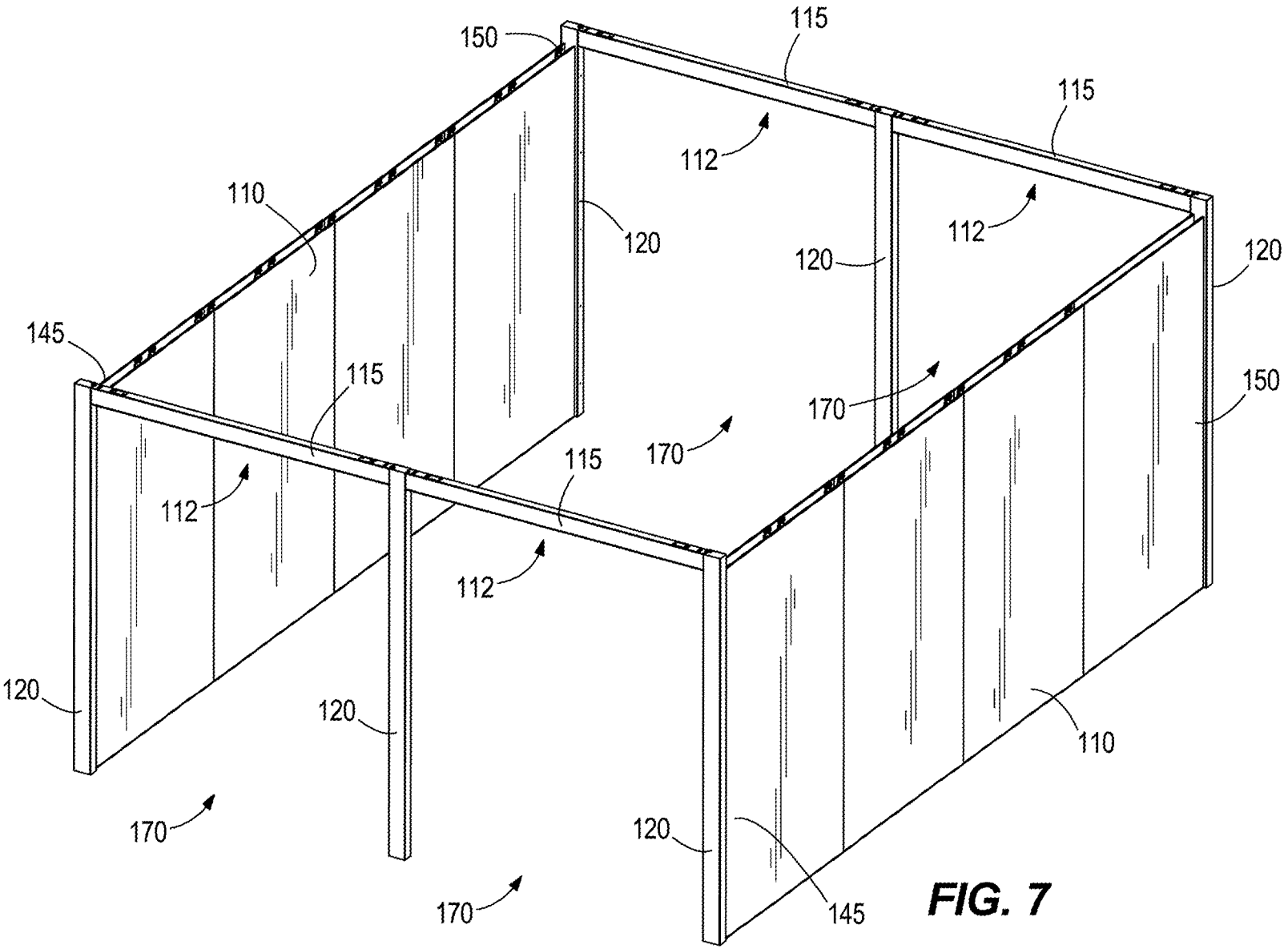
FIG. 7 is a perspective view of another subarchitectural office system including two subarchitectural walls and four arches.

FIG. 7 illustrates another subarchitectural office system 100. The illustrated subarchitectural office system 100 includes a first subarchitectural wall 110, a first arch 112 adjacent the first side edge 145 of the first subarchitectural wall 110, and a second arch 112 adjacent the second side edge 150 of the first subarchitectural wall 110. The subarchitectural office system 100 further includes a second subarchitectural wall 110, a third arch 112 adjacent the first side edge 145 of the second subarchitectural wall 110, and a fourth arch 112 adjacent the second side edge 150 of the second subarchitectural wall 110. The third and fourth arches 112 extend from the second subarchitectural wall 110 towards the first subarchitectural wall 110. The first and third arches 112 share a vertical post 120 that is positioned between the first and second subarchitectural walls 110. Similarly, the second and fourth arches 112 share a vertical post 120 that is positioned between the first and second subarchitectural walls 110. The illustrated subarchitectural office system 100 may also be viewed as having two subarchitectural walls 110 with two arches 112 and two intermediate vertical posts 120. The overhead beams 115 of the arches 112 may vary in length so that the position of the vertical posts 120 between the first and second subarchitectural walls 110 varies. Additionally, infills may be positioned in the openings 170 of one or more of the arches 112.

Figure 8:
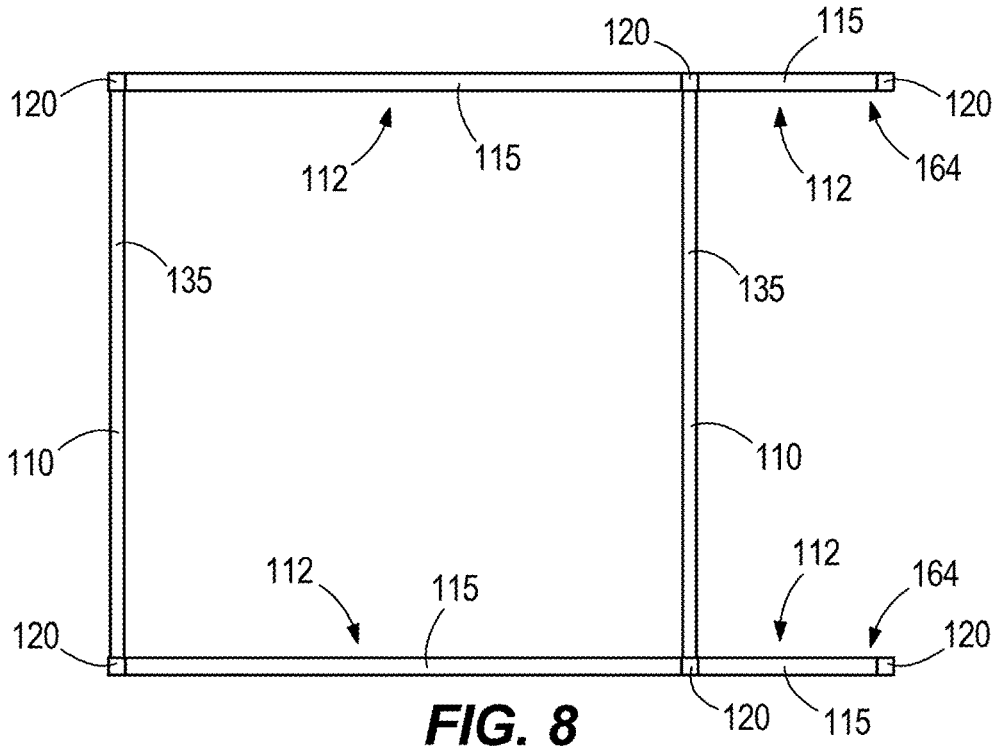
FIG. 8 is a top schematic view of yet another subarchitectural office system including two subarchitectural walls and four arches.

FIG. 8 illustrates another subarchitectural office system 100. The illustrated subarchitectural office system 100 is similar to the subarchitectural office system 100 of FIG. 6, but includes two additional overhead beams 115 and two additional vertical posts 120 forming four total arches 112. The additional overhead beams 115 couple to the top edge 135 of one of the subarchitectural walls 110 at vertical posts 120 and extend outwardly from the subarchitectural wall 110 away from the other overhead beams 115. The two additional vertical posts 120 are coupled to the second ends 164 of the additional overhead beams 115.

Figure 9:
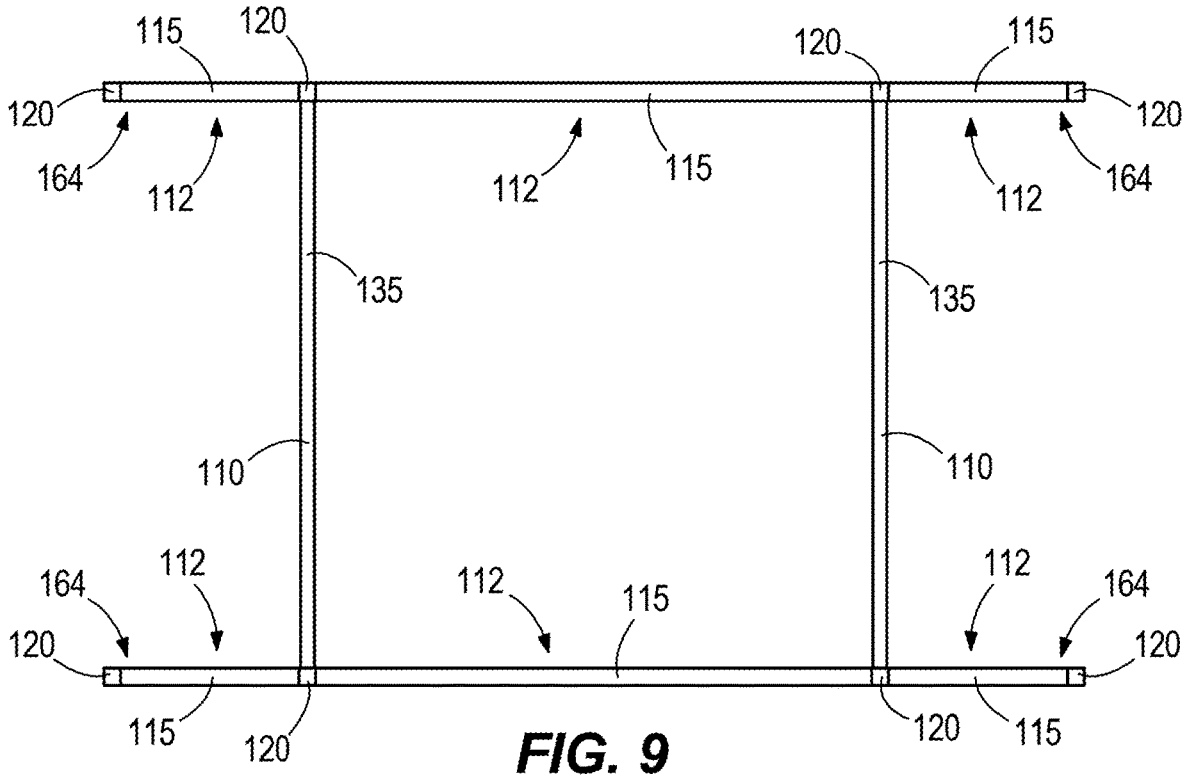
FIG. 9 is a top schematic view of yet another subarchitectural office system including two subarchitectural walls and six arches.

FIG. 9 illustrates another subarchitectural office system 100. The illustrated subarchitectural office system 100 is similar to the subarchitectural office system 108 shown in FIG. 8, but includes a fifth arch 112 and a sixth arch 112 that extend away from the other of the subarchitectural walls 110

FIG. 10 shows an additional configuration of the subarchitectural office system 100. In FIG. 10 the subarchitectural office system 100 includes two core modules 108 back-to-back and coupled by two additional overhead beams 115. In total, there are two subarchitectural walls 110, eight vertical posts 120, and six overhead beams 115. The two core modules 108 define two functional areas 180 and a passageway between the two subarchitectural walls 110. In the functional areas 180 are various accessories such as tables 185, stools 190, and office chairs 195.

As discussed above, FIG. 11 illustrates the subarchitectural office system 100 of FIG. 4A supported by a wall 197 of a building. The subarchitectural office system 100 is generally L-shaped with the subarchitectural wall 110 extending away from the wall 197 of the building. The L-shaped subarchitectural off ice system 100 may also be referred to as a wall start when there is no vertical post 120 on one of the edges 145, 150 of the subarchitectural wall 110. The wall 197 of the building and the subarchitectural wall 110 are generally orthogonal to each other. The second side edge 150 of the subarchitectural wall 110 is positioned on the wall 197 of the building for support. Together, the wall 197 of the building and the subarchitectural wall 110 of the subarchitectural office system 100 define a functional area 180 that is accessible through the arch 112.

Figure 11:
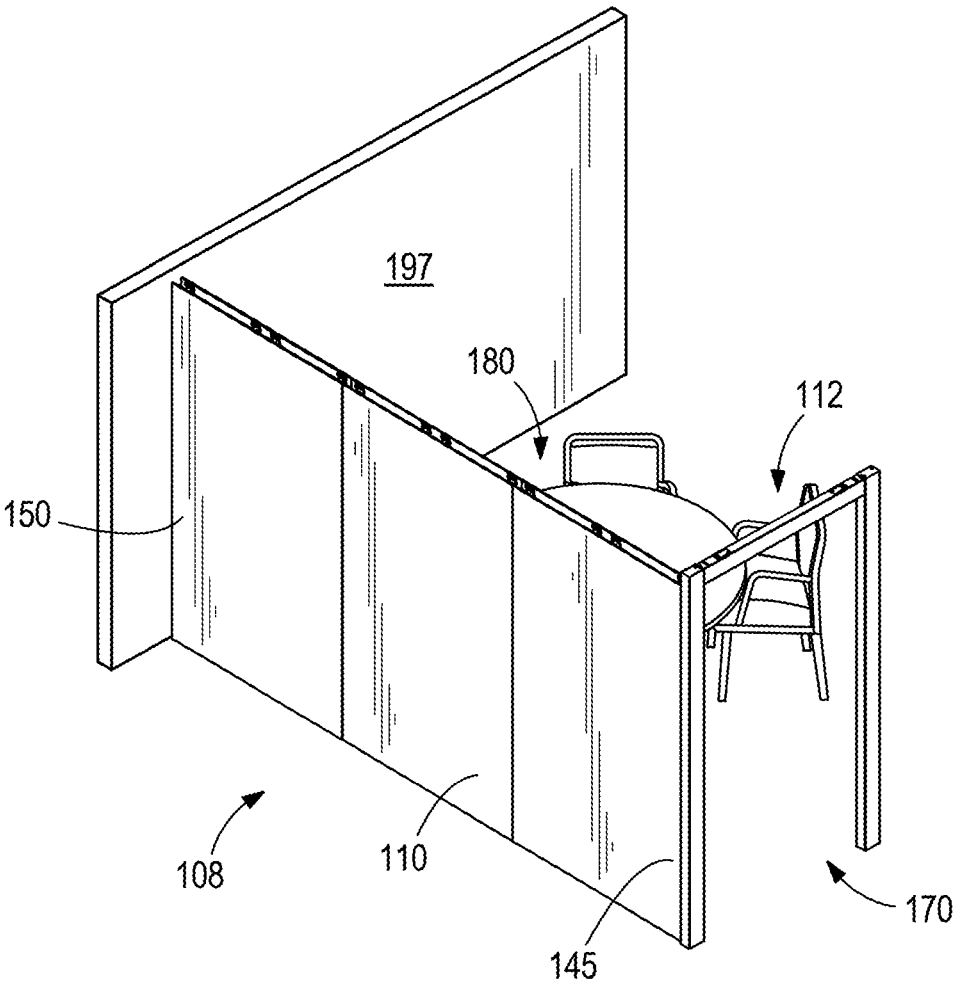
FIG. 11 is perspective view of yet another embodiment of a subarchitectural office system.
Figure 12:
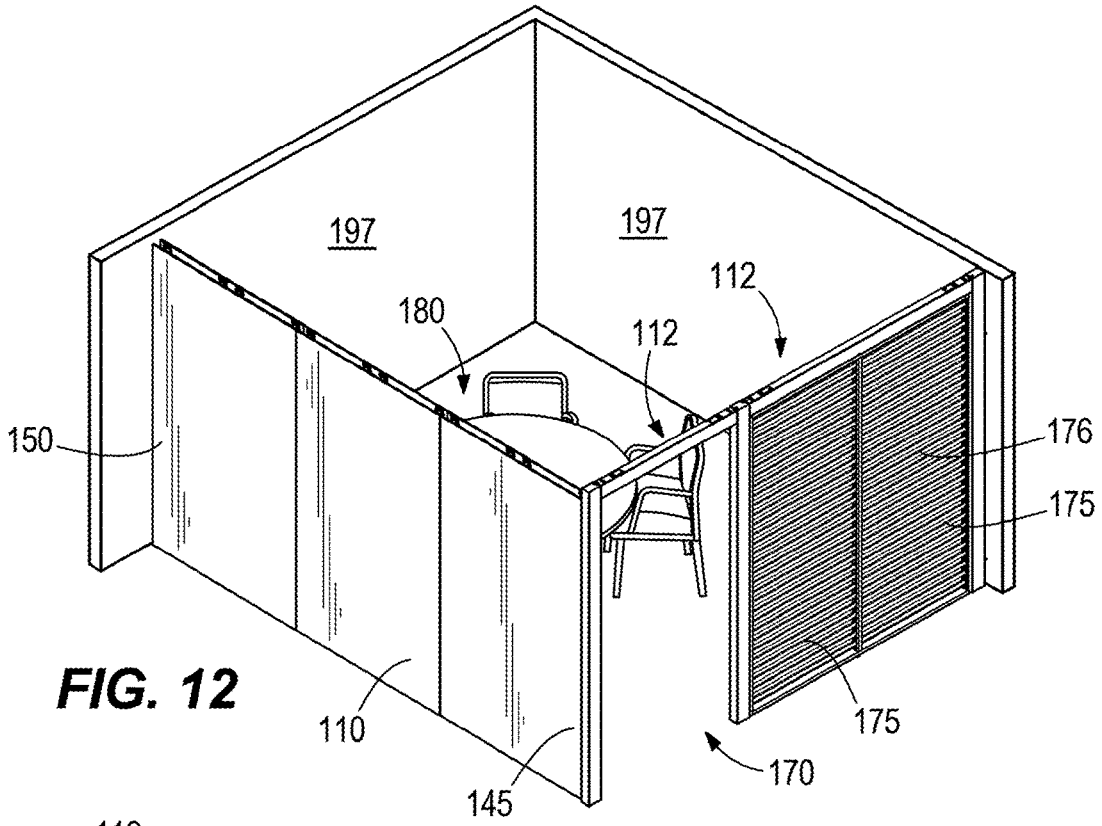
FIG. 12 is a perspective view of yet another embodiment of a subarchitectural office system.

FIG. 12 illustrates a subarchitectural office system 100 that is similar to the subarchitectural office system 100 of FIG. 11, but is supported by multiple walls 197 of a building. The subarchitectural office system 100 is generally L-shaped and includes one subarchitectural wall 110 connected to and extending outwardly from one of the building walls 197, a first arch 112 connected to an edge of the subarchitectural wall 110 opposite the building wall 197 and extending toward the other building wall 198, and a second arch 112 connected to the first arch 112 and the other building wall 197. The second arch 112 defines an opening that is covered by an infill 175 including slats 176. Together, the two walls 197 of the building, the subarchitectural wall 110, and the second arch 112 with the infill 175 define a functional area 180 that is accessible through the first arch 112.

FIG. 13 illustrates an individual sized subarchitectural office system 100. Similar to the subarchitectural office system 100 of FIG. 7, the illustrated subarchitectural office system 100 includes two subarchitectural walls 110 and four arches 112. Two of the arches 112 share a vertical post 120 on a side adjacent one of the edges 145, 150 of the subarchitectural walls 110, and the other two arches 112 share a vertical post 120 on a side adjacent the other edge 145, 150 of the subarchitectural walls 110. Each of the arches 112 defines openings 170 with infills 175. For example, a first arch 112 includes a sliding glass door 177, a second arch includes a glass panel 178, and third and fourth arches include solid panels 178. The two subarchitectural walls 110 and four arches 112 with their infills 175 define an enclosed functional area 180. The functional area 180 may be filed with accessories such as office chairs 195 or may include trellises 205 that are coupled to the top edges 135 of the subarchitectural walls 110. In some embodiments, the individual sized subarchitectural office system 100 may only include three sides that define the functional area 180. In further embodiments, multiple individual sized architectural office systems 100 may be positioned adjacent one another.

FIG. 14 illustrates a group sized subarchitectural office system 100. The subarchitectural office system 100 is similar to the subarchitectural office system 100 of FIG. 13, but includes a generally larger functional area 180. As such, the subarchitectural office system 100 includes two subarchitectural walls 110 and three arches 112: one arch on a side further back (backside) as viewed from FIG. 14 and two arches on a side nearer (front side) as viewed from FIG. 14. The two subarchitectural walls 110 define opposite sides of the subarchitectural office system 100, and the subarchitectural office system 100 further includes a glass panel 178 in between the arch 112 on the backside, a glass panel 178 between one arch 112 on the front side, and a sliding glass door 177 between the other of the arches 112 on the front side. The two subarchitectural walls 110, the glass panels 178, and the sliding glass door 177 define the functional area 180. The functional area 180 includes a table 185, office chairs 195, and trellises 205. The subarchitectural office system 100 further includes a rail 131 on the first subarchitectural wall 110 that supports one or more whiteboards 210, and a mount on the second subarchitectural wall that supports a TV 215. In addition, the subarchitectural office system 100 includes one or more lights 220 supported by and hanging from trellises 205 the ceiling. The TV 215, the lights 220, and any other suitable accessories may be powered by wires running through the subarchitectural walls 110.

In some embodiments, various attachments may be coupled to the subarchitectural office systems 100. The attachments may be used to further divide the subarchitectural office system 100 into smaller workspaces for individual users or small groups of users. For example, an alcove boundary could be coupled to a vertical post 120 and one of the side edges 145, 150 of the subarchitectural wall 110. Alternatively, a carrel desk including a table top and a table boundary can be coupled to a vertical post 120. The attachments can be coupled to the subarchitectural wall 110, the overhead beam 115, or the vertical post 120, and are not limited to any specific position or number of attachments.

Additionally, various accessories can be attached to any of the subarchitectural office systems 100. For example, light fixtures may be hung from or attached to the overhead beams 115 or the vertical posts 120. Banners, screens, panels, dividers, curtains, and other partitions may be hung from overhead beams 115. The partitions may be slidable along tracks or otherwise movable relative to the overhead beams 115 to change the configuration of the subarchitectural office system. In some embodiments, false ceiling elements may be coupled to and extend from the overhead beams 115, such as the trellises 205. Other accessories, such as easels, whiteboards, shelves, support hooks, mounting racks, etc., may also be supported by the subarchitectural walls 110, the overhead beams 115, and/or the vertical posts 120.

Figure 15:
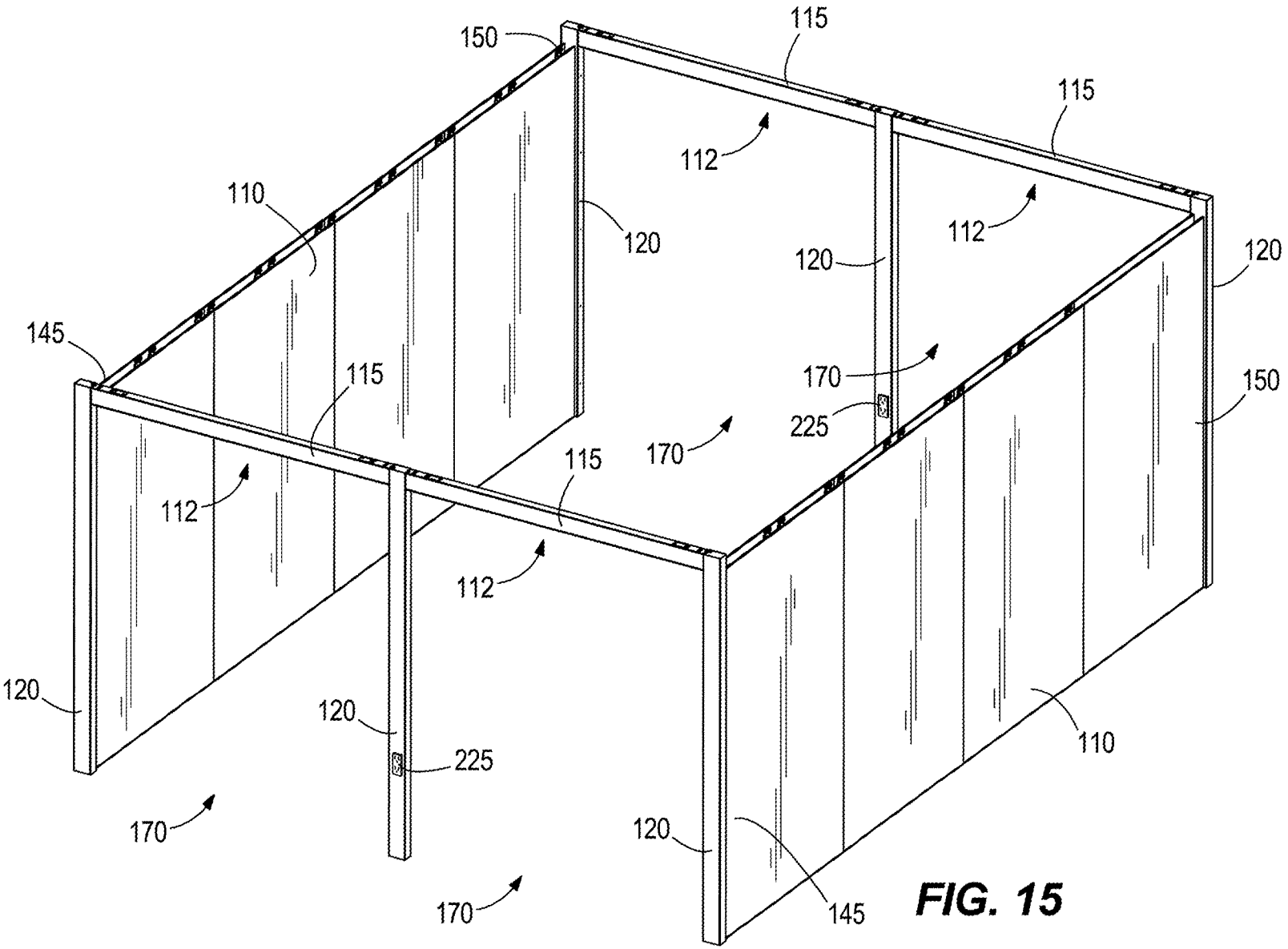
FIG. 15 is a perspective view of a subarchitectural office system including vertical posts with electrical outlets.

As shown in FIG. 15, in some embodiments, the vertical posts 120 of a subarchitectural office system 100 include electrical outlets 225. In other embodiments, electrical outlets may also or alternatively be positioned on overhead beams 115. In further embodiments, the electrical outlets may also or alternatively be positioned on the subarchitectural walls 110. To provide power to each electrical outlets 225, electrical wiring is directed from one of the subarchitectural walls 100, through the inside of the vertical post 120 adjacent the subarchitectural wall 100, through the inside of the overhead beam 115, and down the vertical post 120 supporting the electrical outlet 225. Similarly, electrical wiring can be directed through the inside of the subarchitectural wall 110, the inside of the vertical posts 120, or the inside of the overhead beams 120 to electrical outlets 225 positioned elsewhere in the system 100.

Providing relatively simple subarchitectural office systems 100 including a subarchitectural wall 110 and at least one arch 112 advantageously allows for quick installation of the subarchitectural office system 100 in an open office. With only a few main components for each subarchitectural office system, the office systems 100 can be assembled and disassembled by a small number of people in a relatively short period of time. The variations of the subarchitectural office systems 100 provide users with different configurations to create subarchitectural office systems 100 as desired for different settings, thus providing different functional areas 180 within an open office. The subarchitectural walls 110, the arches 112, and any desired attachments and accessories thereby provide a kit of parts that can be interchanged to form a workspace.

Various features and advantages of the invention are set forth in the following claims.

What is claimed is:

1. A subarchitectural office system comprising:

a first subarchitectural wall having a first top edge, a first side edge, and a second side edge opposite the first side edge;

a second subarchitectural wall facing the first subarchitectural wall, the second subarchitectural wall having a second top edge, a third side edge, and a fourth side edge opposite the third side edge;

a single arch extending between the first and second subarchitectural walls, the single arch including a first vertical post coupled to the first side edge of the first subarchitectural wall, a second vertical post coupled to the third side edge of the second subarchitectural wall, and a first overhead beam extending between the first vertical post and the second vertical post, the first overhead beam including a first end coupled to the first vertical post and a second end coupled to the second vertical post; and a double arch extending between the first and second subarchitectural walls, the double arch including a third vertical post coupled to the second side edge of the first subarchitectural wall, a fourth vertical post coupled to the fourth side edge of the second subarchitectural wall, a fifth vertical post positioned between the third and fourth vertical posts and spaced apart from the first and second subarchitectural walls, a second overhead beam extending between the third and fifth vertical posts, the second overhead beam including a third end coupled to the third vertical post and a fourth end coupled to the fifth vertical post, a third overhead beam extending between the fourth and fifth vertical posts, the third beam including a fifth end coupled to the fifth vertical post and a sixth end coupled to the fourth vertical post.

2. The subarchitectural office system of claim 1, wherein the first vertical post, the second vertical post, and the first overhead beam define a first opening, wherein the third vertical post, the fourth vertical post, and the second overhead beam define a second opening, and wherein the fourth vertical post, the fifth vertical post, and the third overhead beam define a third opening.

3. The subarchitectural office system of claim 2, further comprising a first infill positioned within the first opening and a second infill positioned within the second opening.

4. The subarchitectural office system of claim 3, wherein the first infill includes a first panel that completely fills the first opening, and wherein the second infill includes a second panel that completely fills the second opening.

5. The subarchitectural office system of claim 4, wherein the first panel is a first glass panel, and wherein the second panel is a second glass panel.

6. The subarchitectural office system of claim 4, further comprising a third infill positioned within the third opening.

7. The subarchitectural office system of claim 6, wherein the third infill includes a door.

8. The subarchitectural office system of claim 1, wherein the first subarchitectural wall includes a wall structure and a wall cladding coupled to the wall structure, and wherein the wall structure is coupled to both the first and third vertical posts by fasteners that draw the first and third vertical posts toward each other to compress the wall cladding between the first and third vertical posts, leaving no visible gap between the wall cladding and the first and third vertical posts.

9. The subarchitectural office system of claim 1, further comprising false ceiling elements extending between the first and second overhead beams and between the first and third overhead beams.

10. The subarchitectural office system of claim 1, wherein no overhead beam extends across the first top edge of the first subarchitectural wall between the first and third vertical posts, and wherein no overhead beam extends across the second top edge of the second subarchitectural wall between the second and fourth vertical posts.

11. A subarchitectural office system comprising:

a first arch defining a first opening, the first arch including a first vertical post, a second vertical post, and a first overhead beam extending between the first and second vertical posts;

a second arch defining a second opening, the second arch including a third vertical post, a fourth vertical post, and a second overhead beam extending between the third and fourth vertical posts;

a third arch defining a third opening, the third arch including the fourth vertical post, a third overhead beam, and a fifth vertical post;

a first subarchitectural wall extending between the first vertical post and the third vertical post;

a second subarchitectural wall extending between the second vertical post and the fifth vertical post;

a first infill positioned within the first opening; and a second infill positioned within the second opening;

wherein the first and second subarchitectural walls and the first and second infills define an enclosed functional area.

12. The subarchitectural office system of claim 11, wherein the first infill completely fills the first opening, and wherein the second infill completely fills the second opening.

13. The subarchitectural office system of claim 11, wherein the first subarchitectural wall and the second subarchitectural are parallel to each other.

14. The subarchitectural office system of claim 11, further comprising a third infill positioned in the third opening.

15. The subarchitectural office system of claim 14, wherein the first infill is a first glass panel, the second infill is a second glass panel, and the third infill is a glass door.

16. A four-sided subarchitectural office system that defines a functional area, the four-sided subarchitectural office system comprising:

a first side defined by a first subarchitectural wall;

a second side opposite the first side and defined by a second subarchitectural wall;

a third side including a first arch extending between the first and second subarchitectural walls, the first arch defining a first opening, the third side further including a first infill that completely fills the first opening;

a fourth side opposite the third side, the fourth side including a second arch extending from the second subarchitectural wall and a third arch extending from the second arch to the first subarchitectural wall, the second arch defining a second opening, the third arch defining a third opening, the fourth side further including a second infill that completely fills the second opening.

17. The four-sided subarchitectural office system of claim 16, wherein the first, second, third, and fourth sides are orthogonal to respective adjacent sides.

18. The four-sided subarchitectural office system of claim 16, wherein the fourth side further includes a third infill positioned in the third opening.

19. The four-sided subarchitectural office system of claim 16, wherein the first infill, the second infill, or both are glass panels.

20. The four-sided subarchitectural office system of claim 16, further comprising a workspace accessory mounted to the first subarchitectural wall and facing the second subarchitectural wall.

* * * * *